United States Patent [19]

Mitchell

[11] 4,158,242

[45] Jun. 19, 1979

[54] SHOULDER PAD

[75] Inventor: Hal D. Mitchell, Rolla, Mo.

[73] Assignee: A-T-O Inc., Willoughby, Ohio

[21] Appl. No.: 804,012

[22] Filed: Jun. 6, 1977

[51] Int. Cl.[2] ..... A41D 13/00

[52] U.S. Cl. ..... 2/2; 2/268

[58] Field of Search ..... 2/2, 267, 268

[56] References Cited

U.S. PATENT DOCUMENTS

| | | | |
|---|---|---|---|
| 1,600,410 | 9/1926 | Hartman | 2/2 |
| 1,887,473 | 11/1932 | Warner | 2/2 |
| 2,957,177 | 10/1960 | Turner | 2/2 |
| 3,083,370 | 4/1963 | Havey | 2/2 |
| 3,144,657 | 8/1964 | Groot | 2/268 X |
| 3,366,970 | 2/1968 | Morgan | 2/2 |
| 3,739,397 | 6/1973 | Truelove | 2/2 |

*Primary Examiner*—Werner H. Schroeder
*Assistant Examiner*—Moshe I. Cohen
*Attorney, Agent, or Firm*—Koenig, Senniger, Powers and Leavitt

[57] ABSTRACT

A shoulder pad for football players comprising a chestplate portion, a backplate portion and a pair of arches integrally connecting the plate portions, the arches being laterally spaced to provide an opening for the neck of the wearer with the spacing such that the arches lie adjacent and relatively close to the neck. The arches are relatively narrow in relation to the width of the shoulders. Each of the members has padding on the inside thereof with the padding at the top of the arch extending laterally over the shoulder and having an inner portion generally beneath the arch and an outer portion covering the outer part of the shoulder. The inner and outer portions are hingedly connected with the outer portion having a back section adjacent the backplate and a front section adjacent the chestplate. These sections are separate toward their outer ends so as to provide freedom for raising the arm above a horizonal position by permitting upward movement of the outer part of the shoulder without substantial interference from the outer portion of the padding.

5 Claims, 4 Drawing Figures

SHOULDER PAD

BACKGROUND OF THE INVENTION

This invention relates generally to athletic apparel, and, more particularly, to a shoulder pad for football players which allows greater flexibility of movement.

The shoulder padding on the inside of conventional shoulder pads is of one-piece construction and extends laterally outwardly from a position adjacent the neck to the outer portion of the shoulders. This severely restricts upward movement of the arms and shoulders. Moreover, shoulder pads have heretofore been unduly bulky and cumbersome and thus have further inhibited mobility. Reference may be made to U.S. Pat. No. 2,957,177 which shows a prior art shoulder pad on which the present invention is an improvement.

SUMMARY OF THE INVENTION

Among the several objects of this invention may be noted the provision of an improved shoulder pad allowing greater mobility of the upper body and particularly the shoulders so that the arms may be raised without undue interference from the shoulder pad; the provision of such a shoulder pad which is durable and constructed effectively to absorb blows and to protect the wearer from injury; the provision of such a shoulder pad which is compact and simple in design; and the provision of such a shoulder pad which is economical to manufacture and easy to maintain.

Briefly, a shoulder pad of this invention comprises a left-hand member adapted to fit over the left shoulder and a right-hand member adapted to fit over the right shoulder, each of these members being a relatively rigid member of generally inverted U-shape as viewed from the side and having a chestplate portion, a backplate portion and an arch integrally connecting the plate portions. The arches are laterally spaced to provide an opening for the neck of the wearer with the spacing such that the arches lie adjacent and relatively close to the neck. They are relatively narrow in relation to the width of the shoulders. Each of said members has padding on the inside thereof with the padding at the top of the arch extending laterally over the shoulder and having an inner portion generally beneath the arch and an outer portion covering the outer part of the shoulder. The inner and outer portions are hingedly connected together with the outer portion having a back section adjacent the backplate and the front section adjacent the chestplate. These sections are separate toward their outer ends for allowing them to spread apart as they swing upwardly about the aforesaid hinged connection upon upward movement of the outer part of the shoulder. Thus, freedom is provided for raising the arms above a horizontal position by permitting upward movement of the outer part of the shoulder without substantial interference from the outer portion of the padding.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
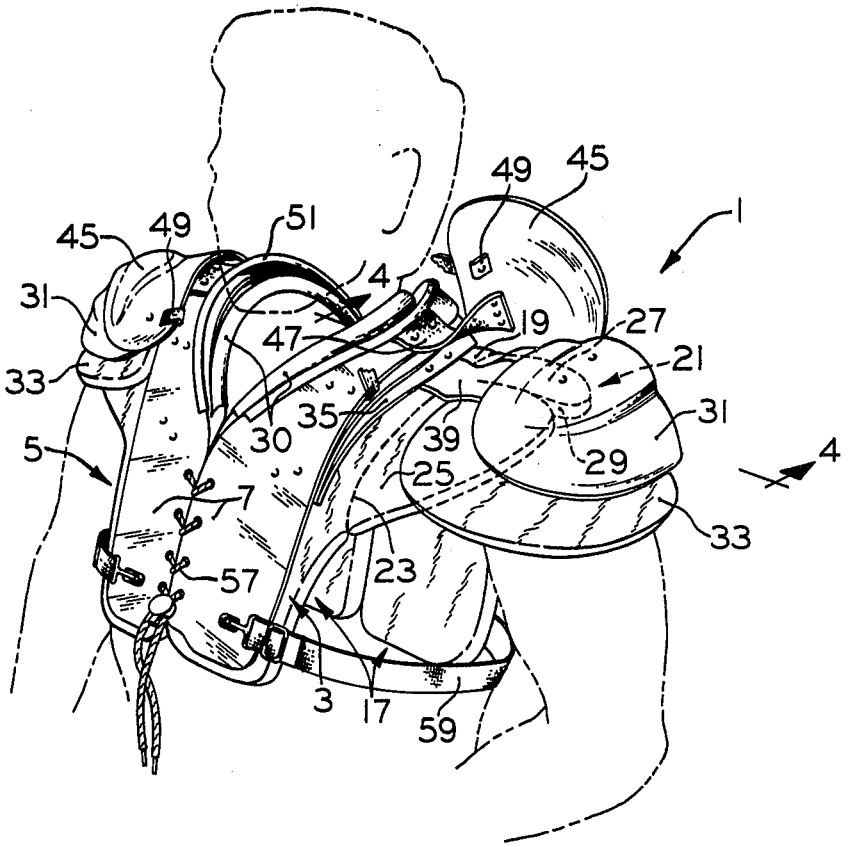
FIG. 1 is a perspective of the shoulder pad of this invention being worn by a football player, a flap of the shoulder pad being raised better to illustrate certain details of the invention.
Figure 4:
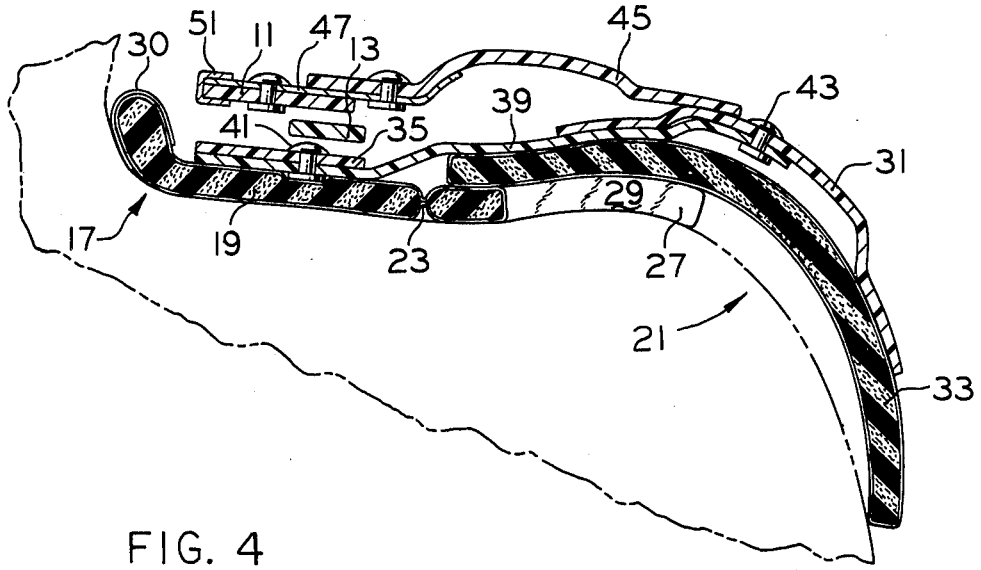
FIG. 4 is an enlarged section on line 4—4 of FIG. 1.

Referring to the drawings, a shoulder pad made according to the present invention is designated generally by the reference numeral 1 and is shown in FIG. 1 worn by a football player. It comprises a left-hand member generally indicated at 3 which fits over the left shoulder of the player and a right-hand member generally indicated at 5 which fits over the right shoulder. These two members 3, 5 may be of a suitable relatively lightweight plastic material, such as a high density polyethylene having a sufficiently high impact resistance to withstand the heavy blows received during the course of a football game. Each of the members is of generally inverted U-shape as viewed from the side and consists of a chestplate 7, a backplate 9 and an arch 11 integrally connecting the plates 7,9. The arches 11 of the two members 3,5 are laterally spaced to provide an opening for the neck of the wearer with a spacing such that the arches lie adjacent and relatively close to the neck. As best illustrated in FIG. 4, each arch 11 is relatively narrow in relation to the width of the shoulder (preferably no more than 1½" wide) and extends through the narrow space between the neck and the upraised outer portion of the shoulder when the arm is raised over the head. A curved, relatively stiff member 13, which may be made of the same plastic as the arch, extends along the underside of the arch and is affixed by rivets 15 at its ends to the arch.

Figure 2:
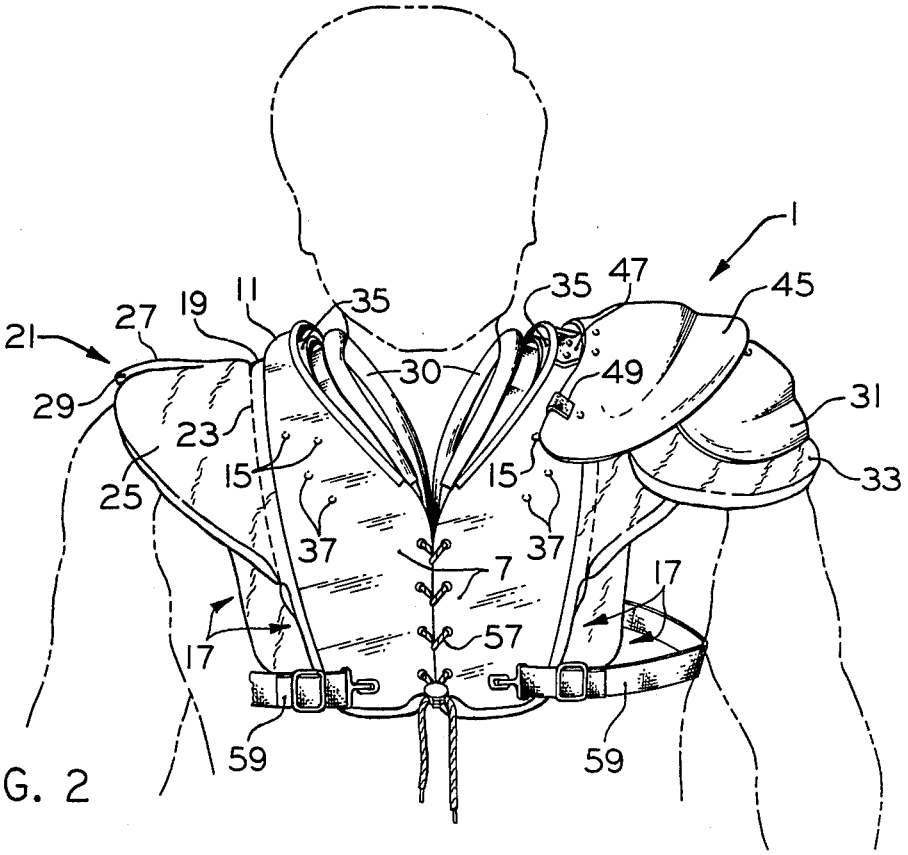
FIG. 2 is a front elevation of FIG. 1 with the flap and cap on one side of the shoulder pad removed.
Figure 3:
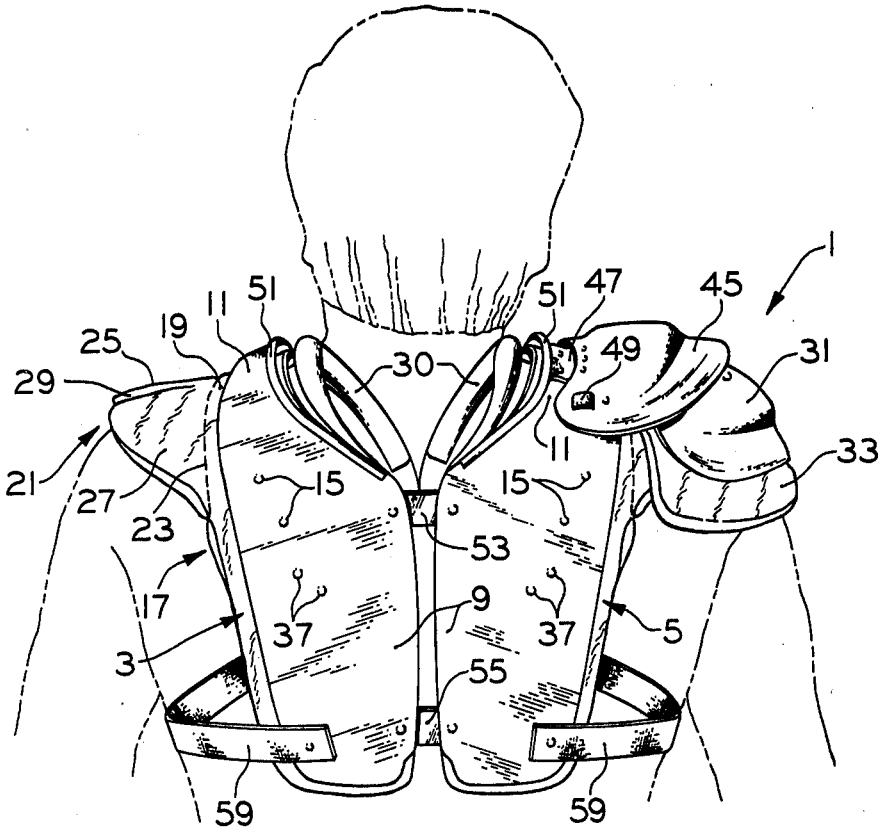
FIG. 3 is a rear elevation of FIG. 1 having portions removed as in FIG. 2.

For added protection, each of the members 3, 5 has padding generally indicated at 17 secured to the inside thereof as by stitching, which padding 17 preferably comprises suitable closed-cell elastomeric vinyl foam in a stretch fabric cover. As shown in FIGS. 3 and 4, the padding 17 at the top of the arch 11 extends laterally over the shoulder and comprises an inner portion 19 beneath the arch overlying the inner part of the shoulder and an outer portion generally indicated at 21 overlying the outer part of the shoulder. In accordance with this invention, the outer portion 21 of the padding 17 is hinged to the inner portion 19 of the padding along a line of stitching 23 and the outer portion 21 of the padding is divided into a front section 25 (see FIG. 2) generally adjacent the chestplate 7 and a back section 27 (see FIG. 3) generally adjacent the backplate 9. These sections 25, 27 are separated toward their outer ends by a notch, indicated at 29, which extends inwardly from the outer edge of the padding 17, the rear edge of the front section 25 of the padding 17 being spaced forward of the front edge of the back section. This hinge-and-notch construction is advantageous in that it allows the front and back sections 25, 27 of the outer portion 21 of the padding to swing easily upwardly about the line of stitching 23 upon upward movement of the outer part of the shoulder, and, in addition, allows the sections freely to spread apart (in accordance with their natural tendency) during such movement. Thus, freedom is provided for raising the arms by permitting upward movement of the outer part of the shoulders without substantial interference from the padding 17. Although the front and back sections 25, 27 are shown connected toward their inner ends in the drawings, it will be understood that these sections may be entirely separate. Welted neck padding 30 is provided along the edges of the padding 17 adjacent the neck to assure that the neck is adequately guarded.

The shoulder pad 1 further comprises a pair of caps, each designated 31, overlying the outer portions 21 of padding 17 and providing additional protection for the outer part of the shoulders. The caps 31 are convex in shape and having padding 33 of the same construction as padding 17 stitched to the inside thereof. As shown in FIGS. 1 and 4, each cap is flexibly connected to a strap 35 of relatively pliable material extending along the inner portion 19 of the padding 17 below the member 13. This strap 35, which may be referred to as a "cantilever" strap, generally corresponds in width to that of the arch and is secured at its ends to the latter by rivets or other suitable permanent fasteners 37. More particularly, the cap 31 is connected to the strap 35 by means of a flexible band 39 extending out from the strap, the inner end of the band (its left end as viewed in FIG. 4) being riveted at 41 to the underside of the strap and the outer end of the band being riveted at 43 to the underside of the cap 31. Inasmuch as the band is connected to the cantilever strap rather than directly to the arch 11 (as is the case with conventional shoulder pads), the front and back sections 25, 27 of the outer portions of the padding fit snugly against the underside of the cap 31 providing a compactness not heretofore found in shoulder pads.

As illustrated in the drawings, a relatively rigid flap 45 overlies each cap 31 and is hinged to the respective arch 11 at the top of the arch via a main hinge strap 47. A trim strip 51 is doubled over the inner edge of each arch 11 and hinge strap 47 for added protection. As indicated at 49, a pair of snubber straps connect the flap 45 to the arch 11 at the front and back of the flap for restricting movement of the flap relative to the arch.

The backplates 9 of the shoulder pad 1 are connected by a parallelogram linkage arrangement which allows the backplates to shift relative to each other generally in the plane of the backplates. More specifically, a first link 53 is pivoted at its ends to the upper portions of the backplates while a second link indicated at 55 pivotally connects the lower portions of the backplates. It will, of course, be understood that additional links could be provided for further strength. As illustrated, the chestplates 7 are adjustably laced together as indicated at 57. Adjustable elastic body straps 59 interconnect the chestplates and the backplates 7, 9 and are worn under the arms of the wearer to prevent displacement of the shoulder pad 1 upwardly and for otherwise keeping the shoulder pad properly positioned on the athlete.

It will be observed from the above that the improved shoulder pad 1 of this invention allows freedom of movement of the upper body and particularly of the shoulders so that the arms may be moved above a horizontal position without substantial interference from the shoulder pad. Moreover, the shoulder pad 1 is constructed effectively to absorb blows and to protect the wearer from injury. Another advantage of the pad is that it is compact yet durable and simple in design for economical manufacture and maintenance.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A shoulder pad for football players comprising a left-hand member adapted to fit over the left shoulder and a right-hand member adapted to fit over the right shoulder, each of said members being a relatively rigid member of generally inverted U-shape as viewed from the side and having a chestplate portion, a backplate portion and an arch integrally connecting said plate portions, said arches being laterally spaced to provide an opening for the neck of the wearer with the spacing such that said arches lie adjacent and relatively close to the neck, said arches being relatively narrow in relation to the width of the shoulders, each of said members having padding on the inside thereof with the padding at the top of the arch extending laterally over the shoulder and having an inner portion generally beneath the arch and an outer portion for covering the outer part of the shoulder, said outer portion being hinged to said inner portion and said outer portion comprising a front section adjacent the chestplate portion, said sections being separate toward their outer ends with the rear edge of said front section forward of the front edge of the back section for allowing the sections to spread apart as they swing upwardly about the hinge upon upward movement of the outer part of the shoulder whereby freedom is provided for raising the arms above a horizontal position by permitting upward movement of the outer part of the shoulder without substantial interference from the outer portion of said padding.

2. A shoulder pad as set forth in claim 1 wherein said front and back sections of said padding are separated by a notch in said outer portion of the padding extending laterally inwardly from the outer edge thereof.

3. A shoulder pad as set forth in claim 1 wherein a strap extends along the inside of each arch at the top of the arch and each of said members further comprises a cap of relatively rigid material flexibly connected to a respective strap for overlying said outer portion of the padding.

4. A shoulder pad as set forth in claim 3 wherein said cap is generally convex in form and said front and back sections are adapted to fit snugly against the underside of the cap.

5. A shoulder pad as set forth in claim 1 wherein said backplate portions are connected by a parallelogram linkage arrangement for allowing the backplate portions to shift relative to each other generally in the plane of the backplate portions.

* * * * *

UNITED STATES PATENT AND TRADEMARK OFFICE

CERTIFICATE OF CORRECTION

PATENT NO. 4,158,242

DATED June 19, 1979

INVENTOR(S) : Hal D. Mitchell

It is certified that error appears in the above-identified patent and that said Letters Patent are hereby corrected as shown below:

Column 1, line 49, "the" (second occurrence) should read -- a --. Column 3, line 10, "having" should read -- have --. Column 4, line 32, claim 1, after "portion" and before the comma, -- and a back section adjacent the backplate portion -- should be inserted.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*